US005439210A

United States Patent [19]

Davis

[11] Patent Number: 5,439,210

[45] Date of Patent: Aug. 8, 1995

[54] BASKETBALL GOAL LOCKING DEVICE

[76] Inventor: Daniel W. Davis, 14329 Riskin Rd., Cedar Lake, Ind. 46303

[21] Appl. No.: 168,533

[22] Filed: Dec. 16, 1993

[51] Int. Cl.[6] ..... A63B 63/08; E05B 65/00

[52] U.S. Cl. ..... 273/1.5 R; 70/57

[58] Field of Search ..... 273/1.5 R, 1.5 A; 70/14, 57, 209, 226; 244/224

[56] References Cited

U.S. PATENT DOCUMENTS

| | | | |
|---|---|---|---|
| 233,162 | 10/1875 | Hayden | D21/01 |
| 2,421,220 | 5/1947 | Robinson et al. | 273/85 |
| 2,708,576 | 5/1955 | Verkuilen | 273/1.5 A |
| 2,892,495 | 6/1959 | Hadden | 160/216 |
| 2,918,283 | 12/1959 | Marschalk | 273/1.5 R |
| 3,017,183 | 1/1962 | Chalcroft | 273/1.5 R |
| 3,348,840 | 10/1967 | Dix | 273/1.5 A |
| 3,522,944 | 8/1970 | Schroeder | 273/1.5 R |
| 3,595,573 | 6/1971 | Kilbourne | 273/1.5 R |
| 5,022,649 | 6/1991 | Traub et al. | 273/1.5 R |
| 5,082,213 | 1/1992 | Torres | 244/224 |
| 5,207,789 | 5/1993 | Gates | 273/1.5 A |

*Primary Examiner*—William H. Grieb
*Attorney, Agent, or Firm*—Schiff Hardin & Waite

[57] ABSTRACT

The invention relates to a locking device for use with a basketball rim. In one embodiment, the device includes two sleeve members in telescoping engagement. The sleeve member ends define C-shaped slots for engagement with a basketball rim. The bodies of the sleeve members define lock-receiving apertures, which align to receive a lock. In a second embodiment, the device comprises a sleeve member including a locking means. One end of the sleeve member defines a C-shaped slot. The body of the sleeve member includes a locking means and an inverted-U-shaped slot.

22 Claims, 1 Drawing Sheet

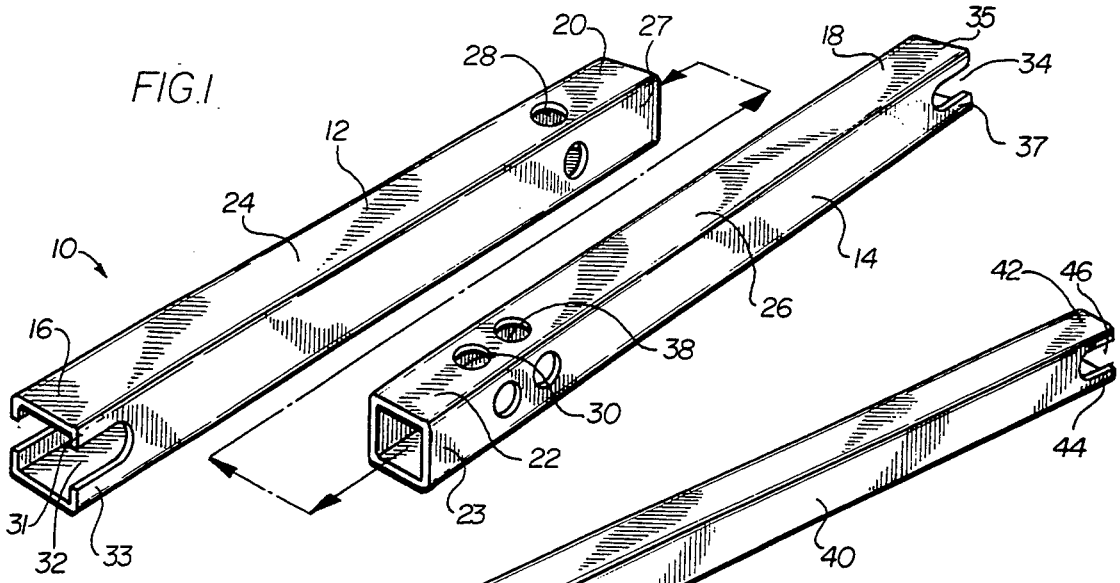
FIG.1
10
12
14
16
18
20
22
23
24
26
27
28
30
31
32
33
34
35
37
38
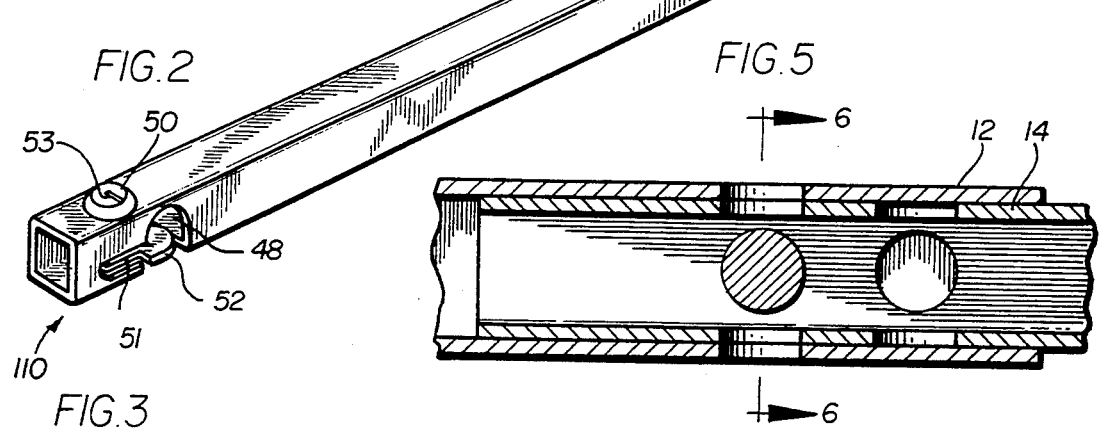
FIG.2
40
42
44
46
48
50
51
52
53
110
FIG.5
6
12
14
6
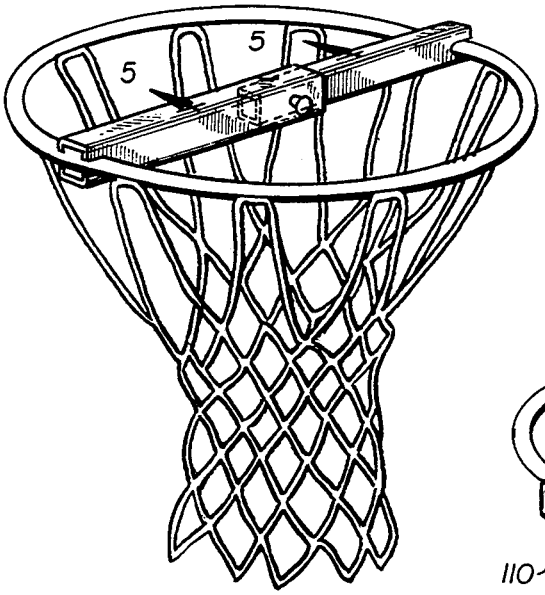
FIG.3
5
5
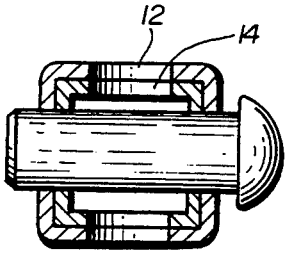
FIG.6
12
14
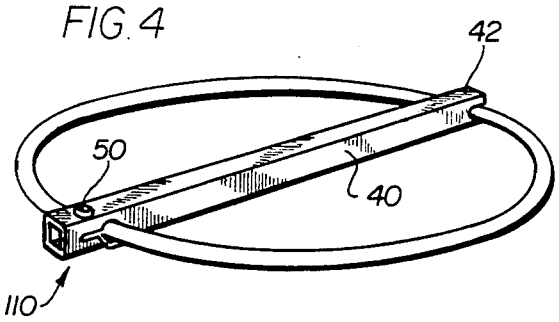
FIG.4
42
40
50
110

BASKETBALL GOAL LOCKING DEVICE

BACKGROUND OF THE INVENTION

The present invention relates generally to locking devices, and more particularly, to a locking device for use in conjunction with a basketball hoop or rim.

Basketball hoops or rims have long been used for indoor and outdoor sporting enjoyment. They are used in a variety of settings, from public parks to private residential driveways. Typically, a basketball rim is mounted to a backboard, which is in turn mounted on a pole, hung from a ceiling, or mounted to a structure such as a garage.

However, basketball rims suffer from the disadvantage that they cannot easily be removed from their mountings when it is desired to prohibit their use. For example, the owner of a basketball rim mounted on a residential garage may wish to prohibit use of the rim at night, when the noise of the basketball hitting the backboard or ground disrupts the sleep of the owner. To prohibit use of the rim, the owner must physically remove the rim from the garage. Obviously, physical removal of the rim each night and replacement each day is time-consuming and inefficient.

In the case of a basketball rim that is mounted on a backboard hung from a ceiling, it is possible to prohibit use of the rim by providing the assembly with a mechanism to raise the rim and attached backboard to the ceiling, thereby prohibiting use of the rim. However, such mechanisms are expensive and potentially dangerous.

Accordingly, a primary object of the present invention is to obviate these problems by providing a locking device for a basketball rim that prohibits use of the rim.

Another object of the present invention is to provide a removable locking device for a basketball rim that is lightweight yet sturdy.

A further object of the invention is to provide a locking device for a basketball rim that is inexpensive to manufacture.

Other objects and advantages of the invention will become apparent upon reading the following detailed description and upon reference to the drawings. Throughout the drawings, like reference numerals refer to like parts.

SUMMARY OF THE INVENTION

The present invention relates to a locking device for use in conjunction with a basketball rim. In one embodiment, the device includes two sleeve members in telescoping engagement. The first end of each sleeve member defines a slot for engagement with a basketball rim, and the second end defines an aperture to receive a security lock. In use, the first end of each sleeve member engages a portion of a basketball rim. The lock-receiving apertures of the respective sleeve members are aligned and receive a security lock. In a second embodiment, the device comprises a sleeve body and a locking means. One end of the sleeve body defines a slot for engagement with a basketball rim. The sleeve member also defines an inverted-U-shaped slot for engagement with the rim. The locking means operates to close the inverted U-slot, thereby locking the device onto the basketball rim.

BRIEF DESCRIPTION OF THE DRAWINGS

FIG. 1 is a perspective view showing one embodiment of the locking device of the present invention in unlocked position and removed from a basketball rim.

FIG. 2 is a perspective view showing a second embodiment of the locking device of the present invention in locked position and removed from a basketball rim.

FIG. 3 is a perspective view showing the device of FIG. 1 in locked engagement with a basketball rim.

FIG. 4 is a perspective view showing the device of FIG. 2 in locked engagement on a basketball rim.

FIG. 5 is a cross-sectional view of the device shown in FIG. 3 taken substantially along the line 5—5.

FIG. 6 is a cross-sectional view of the device shown in FIG. 5 taken substantially along the line 6—6.

DETAILED DESCRIPTION OF PREFERRED EMBODIMENTS

Referring to the drawings, a locking device 10 is provided as shown, for example, in FIG. 1. The locking device 10 is substantially straight, and preferably is constructed of steel. The steel is coated to prevent rust and to minimize scratching of the basketball rim to which the locking device 10 is attached. A suitable coated steel tubing is sold under the trademark RED-KOTE®, manufactured by Welded Tube Co. of America of Chicago, Ill. The thickness of the walls of the tubing of the embodiments shown in FIGS. 1–6 is approximately 0.083 inch.

In the embodiment of the invention shown in FIG. 1, the locking device 10 comprises a first sleeve member 12 and a second sleeve member 14. As shown in FIG. 6, the first sleeve member 12 is substantially square in cross section. The second sleeve member 14 is also substantially square in cross section. It is believed that the sleeve members 12, 14 can be of circular or other cross-sectional shape, so long as the required strength and durability of the device is achieved. The first sleeve member 12 is provided with a first end 16, a second end 20, and a sleeve body 24. The second sleeve member 14 is provided with a first end 18, a second end 22, and a sleeve body 26.

In order to provide a removable locking device in accordance with the invention, the second sleeve member 14 is of slightly decreased cross-sectional area relative to the first sleeve member 12. In this way, the second sleeve member 14 can be received in the first sleeve member 12 in telescoping arrangement, as shown in FIG. 3.

In order to allow the first and second sleeve members 12, 14 securely to engage a basketball rim, the first sleeve ends 16, 18 each terminate in a pair of legs 31, 33 and 35, 37, respectively. In turn, the legs 31, 33 and 35, 37 each define a C-shaped slot 32, 34, respectively The bights of the C-shaped slots 32, 34 are slightly larger than the diameter of the circular rod comprising a regulation basketball rim. In this way, the C-shaped slots 32, 34 are able to be placed over a portion of a basketball rim, thereby engaging the rim in a snug fit, as shown in FIG. 3. In accordance with another aspect of the invention, the legs 31, 33 and 35, 37 extend beyond the periphery of the engaged rim, thereby enabling the locking device 10 to better withstand a removal force, as also shown in FIG. 3.

To enable the locking device 10 to be locked onto a basketball rim or goal, thereby prohibiting use of the rim or goal in accordance with one objective of this invention, the second ends 20, 22 each define at least one lock-receiving aperture 28, 30. When the first and second sleeve members 12, 14 are in telescoping arrangement, as shown in FIG. 3, the lock-receiving apertures 28, 30 may be aligned so as to receive a security lock. One or both of second ends 20, 22 may be provided with more than one lock-receiving aperture, thereby enabling the locking device 10 to engage different standard sizes of basketball rims. As shown here in FIG. 1, the second end 22 is provided with a first and second lock-receiving aperture 30, 38. When the lock-receiving aperture 28 of the first sleeve member 12 is aligned with the lock-receiving aperture 38 of the second sleeve member 14, the locking device 10 will extend to engage a regulation 18-inch diameter basketball rim. However, if it is desired to engage the locking device 10 to an oversized basketball rim, typically measuring 22½ inches in diameter, the sleeve member 26 is simply extended so that the lock-receiving aperture 28 of the first sleeve member 12 aligns with the lock-receiving aperture 30 of the second sleeve member 14.

To provide a removable locking device that is lightweight yet better able to withstand a removal force, the second ends 20, 22 terminate in sleeve extensions 27, 23, respectively. The sleeve extensions 27, 23 extend a sufficient distance beyond the lock-receiving apertures 28, 30 to better permit the locking device 10 to withstand a removal force on the locking device 10 when the locking device 10 is in locked engagement with a basketball rim. Here, the sleeve extensions 27, 23 extend approximately one and one-half inches beyond the lock-receiving apertures 28, 30. When the locking device 10 is assembled (as discussed below) and in locking engagement with a basketball rim, the sleeve extensions 27, 23 operate as reinforcing sections, thereby enabling the locking device 10 to better withstand a removal force at any point on the device.

In accordance with another aspect of the invention, the locking device 10 is easy to operate. First, the second end 22 of the second sleeve member 14 is inserted into the second end 20 of the first sleeve member 12. Second, one end of the locking device 10 is engaged to a basketball rim. Specifically, one of the C-shaped slots 32, 34 (it does not matter which) is positioned on the rim so as to receive the rim in a snug engagement, with the legs 35, 37 (or 31, 33, as applicable) extending beyond the exterior periphery of the rim. Third, the locking device 10 is positioned by the telescoping action of second sleeve member 14 in first sleeve member 12 so that the legs 35, 37 (or 31, 33) and the second C-shaped slot 32, 24 (i.e., the unengaged slot) extend to receive and engage a portion of the basketball rim directly opposite the point of engagement of the first C-shaped slot 32, 34 to have engaged the rim. The positioning of the second sleeve member is perfected when the lock-receiving aperture 28 aligns with either of the lock-receiving apertures 30, 38 (depending, of course, on the size of the rim to be locked). Finally, a security lock is passed through the aligned lock-receiving apertures 28 and 30 or 38, and locked. It will be seen that once the security lock is locked, any telescoping movement of the first and second sleeve members 12, 14 is prohibited. Resultingly, the legs 31, 33 and 35, 37 prohibit removal of the locking device 10 from the rim until the security lock is unlocked and removed from the lock-receiving apertures 28 and 30 or 38, and the first and second sleeve members 12 and 14 are able to resume their telescoping movement.

As shown in FIG. 3, mechanical locks other than a security padlock may be utilized with the locking device 10. For example, a pin can be placed in the aligned lock-receiving apertures 28 and 30 or 38. Such locks can be utilized where attempted removal of the locking device 10 is not anticipated.

In a second embodiment, the locking device 110 includes a sleeve member 40. The sleeve member 40 terminates at one end in legs 42, 44. The legs 42, 44 define a C-shaped slot 46. The bight of the C-shaped slot 46 is slightly larger than the diameter of a regulation basketball rim. In this way, the C-shaped slot 46 is able to be placed over a portion of a basketball rim, thereby engaging the rim in a snug fit, as shown in FIG. 4.

To allow the locking device 110 fully to engage a basketball rim, the other end of the sleeve member 40 defines an inverted-U-shaped aperture 48. The inverted-U-shaped aperture 48 is positioned at a location either approximately 18 inches or 22½ inches from the C-shaped aperture 46, depending on the size of the basketball rim to which the locking device 10 is to be locked.

To enable the locking device 110 to be secured to a basketball rim, the sleeve member 40 is provided with a locking means 50, as shown in FIG. 2. Here, the locking means 50 is a cam lock that includes a flange 52 which rotates in a single plane upon the action of a rotating cylinder 51. The rotating cylinder 51 includes a security key locking means 53. Alternatively, the rotating cylinder 51 can include a non-security locking means such as a knob or an aperture for receiving a tool such as an allen wrench.

In operation, with the locking means 50 in open position, the sleeve member 40 is positioned over a basketball rim such that the C-shaped aperture 46 receives a portion of the rim. The inverted-U-shaped slot 48 is next positioned and fitted over a portion of the rim opposite the engagement of the rim and the C-shaped aperture 46. The locking means 50 is operated or turned to a locked position. As shown in FIG. 4, when the locking means 50 is turned to locked position, the flange 52 operates to close the mouth of the inverted-U-shaped slot 48, thereby prohibiting removal of the locking device 110 from the rim until the flange is moved to the unlocked position.

As will be appreciated, when the locking device 10, 110 engages a basketball rim, the device closes the opening formed by the rim, thereby preventing the passage of a basketball through the rim. As shown in FIGS. 3 and 4, the locking device 10, 110 preferably substantially extends along a line delineating the diameter of the circle formed by the rim. When so positioned, the device 10, 110 cannot be removed from the rim.

It can be appreciated from the foregoing description that the preferred embodiments of the present invention provides a locking device that can be easy installed on a basketball rim to prohibit use of the rim. Further, the preferred embodiment of the locking device is lightweight yet able to withstand a removal force.

The present invention has been described with respect to certain embodiments and conditions, which are not meant to and should not be construed to limit the invention. Those skilled in the art will understand that variations from the embodiments and conditions described herein may be made without departing from the invention as defined in the appended claims.

I claim:

1. A locking device for removable attachment to the rim of a basketball goal, comprising at least one but no more than two sleeve members and a lock for securing at least one sleeve member to the rim, and wherein at least one sleeve member has a rim-receiving slot.

2. The locking device of claim 1, wherein the device includes first and second sleeve members in telescoping engagement.

3. The locking device of claim 2, wherein the first and second sleeve members each include a body and each terminate in a leg that defines a C-shaped slot for complete overlapping engagement with the rim.

4. The locking device of claim 3, wherein each sleeve member body defines at least one lock-receiving aperture.

5. The locking device of claim 3, wherein said legs forming said C-shaped slot each have a length that is longer than the distance between said legs, such that the ends of said legs extend beyond the end of said rim.

6. The locking device of claim 2, wherein each sleeve member includes a body that defines at least one lock-receiving aperture.

7. The locking device of claim 1, wherein the sleeve member includes a body that defines at least one lock-receiving aperture.

8. The locking device of claim 1, wherein the sleeve member includes a sleeve body and first and second sleeve ends, and further wherein at least one of the sleeve ends defines a C-shaped slot for complete overlapping engagement with the rim.

9. The locking device of claim 8, wherein the sleeve member includes a sleeve body and first and second ends, and further wherein one of the ends defines an inverted-U-shaped slot for complete overlapping engagement with the rim.

10. The locking device of claim 1, wherein the sleeve member includes a sleeve body and first and second ends, and further wherein one of the ends defines an inverted-U-shaped slot for complete overlapping engagement with the rim.

11. The locking device of claim 1, wherein the device has only one sleeve member.

12. The locking device of claim 11, wherein the sleeve member includes a body and terminates in a leg that defines a C-shaped slot for complete overlapping engagement with the rim.

13. The locking device of claim 12, wherein the sleeve body includes first and second ends, and further wherein one of the ends defines an inverted-U-shaped slot for complete overlapping engagement with the rim.

14. The locking device of claim 1, wherein the sleeve member includes a sleeve body and first and second ends, and further wherein one of the ends defines an inverted-U-shaped slot for complete overlapping engagement with the rim.

15. A locking device for attachment to the rim of a basketball goal, comprising:

a first sleeve member including a first sleeve body and first and second ends, wherein the first sleeve body defines at least one lock-receiving aperture, one of the ends terminates in legs that define a C-shaped slot for complete overlapping engagement with the rim, and the opposite sleeve end terminates in a sleeve extension;

a second sleeve member including a second sleeve body and first and second ends, wherein the second sleeve body defines at least one lock-receiving aperture for alignment with a lock-receiving aperture of the first sleeve member, and is of sufficient diameter to engage the first sleeve member in telescoping arrangement, and further wherein one of the sleeve ends terminates in legs that define a C-shaped slot for complete overlapping engagement with the rim, and the opposite sleeve end terminates in a sleeve extension; and the lock-receiving apertures of the first and second sleeve members can be aligned to receive a lock.

16. A basketball goal comprising a rim and a locking device, wherein the locking device includes at least one sleeve member having a basketball rim-receiving slot and a lock, and a second sleeve member in telescoping engagement with the first sleeve member.

17. The basketball goal of claim 16, wherein the first and second sleeve members each include a body and each terminate in legs that define a C-shaped slot for complete overlapping engagement with the rim of the basketball goal.

18. The basketball goal of claim 17, wherein each sleeve member body defines at least one lock-receiving aperture.

19. The basketball goal of claim 16, wherein each sleeve member includes a body that defines at least one lock-receiving aperture.

20. A basketball goal comprising a rim and a locking device, the locking device further comprising:

a first sleeve member including a first sleeve body and first and second ends, wherein the first sleeve body defines at least one lock-receiving aperture, one of the ends terminates in legs that define a C-shaped slot for complete overlapping engagement with the rim, and the opposing sleeve end terminates in a sleeve extension;

a second sleeve member including a second sleeve body and first and second ends, wherein the second sleeve body defines at least one lock-receiving aperture for alignment with the lock-receiving aperture of the first sleeve member and is of sufficient diameter to engage the first sleeve member in telescoping arrangement, and further wherein one of the sleeve ends terminates in legs that define a C-shaped slot for receiving the rim, and the opposite sleeve end terminates in a sleeve extension; and a lock removably engaging the lock-receiving apertures of the first and second sleeve members.

21. A basketball goal comprising a rim and a locking device, wherein the locking device includes at least one sleeve member having a basketball rim-receiving slot and a lock, and the sleeve members of the locking device includes a sleeve body and first and second sleeve ends, and further wherein at least one of the sleeve ends defines a C-shaped slot for complete overlapping engagement with the rim.

22. A basketball goal comprising a rim and a locking device, wherein the locking device includes at least one sleeve member having a basketball rim-receiving slot and a lock, and the sleeve member of the locking device includes a sleeve body and first and second ends, and further wherein one of the sleeve ends terminates in legs that define a C-shaped slot and completely overlappingly engage the rim, and the sleeve body defines an inverted-U-shaped slot that completely overlappingly engages the rim, and the lock comprises a rotating cylinder with a flange to close the inverted-U-shaped slot upon rotation of the cylinder.

* * * * *